US010361497B2

(12) United States Patent
Kloppenburg et al.

(10) Patent No.: US 10,361,497 B2
(45) Date of Patent: Jul. 23, 2019

(54) ELECTRIC TERMINAL BLOCK

(71) Applicant: Phoenix Contact GmbH & Co. KG, Blomberg (DE)

(72) Inventors: Christian Kloppenburg, Büren Wewelsburg (DE); Denis Habirov, Bielefeld (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 15/755,119

(22) PCT Filed: Aug. 19, 2016

(86) PCT No.: PCT/EP2016/069682
§ 371 (c)(1),
(2) Date: Feb. 26, 2018

(87) PCT Pub. No.: WO2017/032703
PCT Pub. Date: Mar. 2, 2017

(65) Prior Publication Data

US 2018/0261934 A1 Sep. 13, 2018

(30) Foreign Application Priority Data

Aug. 26, 2015 (DE) ..... 10 2015 114 186

(51) Int. Cl.
*H01R 9/26* (2006.01)
*H01R 9/22* (2006.01)
(Continued)

(52) U.S. Cl.
CPC ..... *H01R 9/2666* (2013.01); *H01R 9/223* (2013.01); *H01R 9/2491* (2013.01);
(Continued)

(58) Field of Classification Search
CPC .... H01R 9/223; H01R 9/2666; H01R 9/2491; H01R 9/2633; H01R 24/58; H01R 13/7033
See application file for complete search history.

(56) References Cited

U.S. PATENT DOCUMENTS 7,666,037 B2 2/2010 Diessel
9,153,916 B2 10/2015 Schloo et al.
(Continued)

FOREIGN PATENT DOCUMENTS

DE 20 2010 017 964 U1 6/2013
DE 10 2015 102 257 A1 8/2016
WO 2016/131703 A1 8/2016

*Primary Examiner* — Briggitte R. Hammond
(74) *Attorney, Agent, or Firm* — David S. Safran; Roberts Mlotkowski Safran Cole & Calderon, P.C.

(57) ABSTRACT

An electric terminal block having a terminal housing, two conductor connection elements in the housing, and two current bars. Each current bar has a connection portion and a resilient contact portion. Each connection portion is paired with a respective conductor connection element, and the contact portions together form a contact region for receiving and contacting the plug of a test plug or disconnecting plug. The contact portions contact each other when no plug is plugged in such that the two conductor connection elements are electrically connected together via the two current bars. A transverse connection between two conductor connection elements of two adjacent terminal blocks is produced automatically when a test plug or disconnecting plug is plugged onto the terminal blocks. The terminal housing has two spring elements that have a resilient contact portion; the contact portions of the spring elements together form an additional contact region for the plug.

10 Claims, 6 Drawing Sheets

(51) Int. Cl.

| | |
|---|---|
| ***H01R 9/24*** | (2006.01) |
| ***H01R 13/703*** | (2006.01) |
| *H01R 24/58* | (2011.01) |

(52) U.S. Cl.
CPC ..... *H01R 13/7033* (2013.01); *H01R 9/2633* (2013.01); *H01R 24/58* (2013.01); *H01R 2201/20* (2013.01)

(56) References Cited

U.S. PATENT DOCUMENTS

| | | | |
|---|---|---|---|
| 9,476,909 | B2 | 10/2016 | Kloppenburg |
| 2015/0147909 | A1 | 5/2015 | Gebhardt et al. |

ELECTRIC TERMINAL BLOCK

BACKGROUND OF THE INVENTION

Field of the Invention

The invention relates to an electrical terminal block, with a terminal housing, with at least two conductor connecting elements which are located in the latter, and with two conductor bars which each have one connecting section and at least one resilient contact section according to the preamble of claim 1. In addition, the invention relates to another block of terminal blocks consisting of at least two terminal blocks which are located next to one another and of at least one plug-in jumper which has at least two legs.

Electrical terminal blocks have been used in the millions for decades in the wiring of electrical installations and devices. The terminals are often latched onto mounting rails which for their part can be located in a plurality in a control cabinet. Moreover, terminal blocks can also be mounted severally as a block of terminal blocks in a wall opening, in particular in an opening in a control cabinet door. This has the advantage that one side of the terminals, the operator side, is accessible from outside the control cabinet without the control cabinet having to be opened, while the other side of the terminal, the connection side, is only accessible when the control cabinet has been opened.

Screw-type terminals or tension spring terminals are often used in terminal blocks as conductor connecting elements. The clamping principle of tension spring terminals is similar to that of screw technology. While in screw terminals a tension sleeve draws the conductor against the conductor bar by actuating the clamping screw, in the tension spring terminal this task is assumed by the tension spring. In addition, insulation piercing connecting devices and leg spring terminals are also being increasingly used; compared to tension spring terminals they have the advantage that to insert a conductor the terminal need not be opened using a tool.

Electrical terminal blocks are often connecting terminals so that they have at least two conductor connecting elements which are electrically connected to one another via an electrically conductive connecting bar, the conductor bar. In addition to this basic type of terminal block which is often also called a feed-through terminal, there are a host of other terminal block types which are adapted specifically to the respective applications. Examples here include protective conductor terminals, isolating blade terminals and installation terminals.

In switching, measurement, test and control engineering, pass-through terminals with an isolating possibility which are therefore in part also called isolating terminals are often used. The isolation possibility which is implemented in this terminal block, i.e., the gap provided in the conductor bar, makes it possible to plug various plugs with different functions into the terminal block, which plugs then make contact with the conductor bar at the gap. In particular, in addition to simple isolating plugs or through-connectors, plugs can also be test plugs which can have special components and can enable the checking of proper operation of the circuit which is connected to the terminal block. Since electrical terminal blocks are usually made disk-shaped, they are generally plugged together with several other electrical terminal blocks into a block of terminal blocks. Then a number of test plugs corresponding to the number of terminal blocks can be plugged into such a block of terminal blocks.

Description of Related Art

Terminal blocks with gaps are used in particular for the connection of current transformers. One important functional feature here consists that a connected current transformer is short-circuited when the secondary circuit is separated from the load.

German Patent Application DE 10 2006 052 894 A1 and corresponding U.S. Pat. No. 7,666,037 B2 disclose a terminal block from which this invention proceeds. This document moreover discloses another test plug and a test terminal block consisting of a plurality of terminal blocks which are located next to one another and of a corresponding number of test plugs. The individual terminal blocks each have two conductor bars whose contact sections make contact with one another when the plug of a test plug is not plugged into the contact region which has been formed by the contact sections. If the plug of a test plug has been fully plugged into the contact region, the two contact sections are separated from one another by the plug, the current flow then being routed via the plug so that a test procedure can be carried out. The terminal block and the assigned test plug then work according to the break-contact principle since the connection between the two conductor bars of the terminal block is being opened when the plug which has two metal sections which are insulated from one another is plugged into the contact region.

In order to ensure reliable and defined contact states when the test plug is being plugged into the contact region, in the known electrical terminal block, the conductor bars are made such that they form two contact regions which are located in succession in the insertion direction of the plug. Making a defined second contact region which is located upstream of the first contact region in the insertion direction of the plug ensures that when the plug is being inserted first a reliable electrical connection between the metal sections of the plug of the test plug and the two conductor bars arises before the first contact region is opened as the plug continues to be inserted and in this way the two conductor bars are electrically separated from one another.

Cross bridging to an adjacent terminal block takes place in this test plug system by plugging the test terminal block into the block of terminal blocks, a plug-in jumper having to be plugged into two adjacent test terminals of the test terminal block.

German Patent Application DE 10 2011 113 333 A1 and corresponding U.S. Pat. No. 9,153,916 B2 also disclose an electrical terminal block in the form of a test terminal. In this terminal block, in the housing there are likewise two conductor connecting elements and two conductor bars. The two conductor bars each have, in addition to one connecting section and a first contact section, also another second contact section. The first contact sections are spaced apart from one another and only when the plug has been plugged in are they electrically conductively connected to one via the plug so that this terminal block operates according to the make-contact principle.

Moreover, there are still two further conductor bar pieces in the housing, in at least one of the conductor bar pieces a recess being formed for plugging in one leg of a plug-in jumper. One of the conductor bar pieces at a time is thus assigned to one of the conductor bars such that the second contact region of one conductor bar makes contact with the assigned conductor bar piece due to the spring force of the conductor bar when a plug has not been plugged in. The conductor bars of the terminal block are then each electrically conductively connected to the conductor connecting element with their connecting section and to the respective conductor bar piece with their second contact section. If a plug of a test plug is being plugged into the contact region, the two conductor bars are deflected such that the second contact section of one conductor bar is spaced apart from the assigned conductor bar piece. Thus the electrical connection between a conductor connecting element and the assigned conductor bar piece is then broken.

In the electrical terminal block known from German Patent Application DE 10 2011 113 333 A1 and corresponding U.S. Pat. No. 9,153,916 B2, when the test plug has not being plugged in, cross bridging to an adjacent terminal block takes place in that one leg of a plug-in jumper at a time is plugged into the recess provided for this purpose in the respective conductor bar pieces of two adjacent terminal blocks so that the two conductor bar pieces are connected to one another via the plug-in jumper. The electrical cross connection between the two conductor connecting elements of two terminal blocks then takes place via the respective conductor bars, the conductor bar pieces and the plugged-in plug-in jumper.

SUMMARY OF THE INVENTION

The object of this invention is to make available the initially described electrical terminal block which is especially well suited for connection of current transformers, its to be ensured that a cross connection between two conductor connecting elements of two adjacent terminal blocks takes place automatically when a test plug or isolating plug is being slipped onto the terminal blocks.

In the electrical terminal block of the type to which this invention is directed, this object is achieved in that there are two spring elements in the terminal housing which each have one resilient contact section, the contact sections of the two spring elements together forming another contact region for the plug which is located in the plug-in direction of the plug upstream of the contact region of the conductor bars. If a plug is plugged into the terminal block, one spring element at a time is connected in an electrically conductible manner via the plug to one conductor bar. Moreover, at least one of the two spring elements has a receiver for one leg of a plug-in jumper so that when the plug-in jumper has been plugged in, cross bridging between adjacent terminal blocks is automatically produced when one plug of a test plug or isolating plug at a time is being plugged into the two terminal blocks.

In accordance with the invention, in the terminal block there are two leading spring elements in the terminal hosing so that when the plug of a test plug or isolating plug is being plugged in it makes contact first with the contact sections of the spring elements before the plug meets the contact sections of the conductor bars and likewise makes contact with them. Before the plug of a test plug or isolating plug thus breaks the contact between the contact sections of the two conductor bars, electrical contact is established between the plug and the additional spring elements. Then an electrically conductive connection between one spring element at a time and the assigned conductor bar takes place via the plug of a test plug or isolating plug which has been plugged into the terminal block.

According to one advantageous configuration of the terminal block in accordance with the invention, the resilient contact sections of the two spring elements are each made roughly C-shaped or V-shaped. The two contact sections of the two spring elements facing one another are used here as a type of entry funnel for the plug of the test plug or isolating plug which is to be plugged in so that the risk of canting is minimized and the plug is at the same time guided into the contact region. Due to the configuration and flexure of the contact sections of the spring elements, the contact force being applied by the spring elements to a plugged-in plug can be accordingly easily matched to the respective requirements.

Preferably the two spring elements, in addition to the contact section, have another connecting section in which the receiver for plugging in one leg of the plug-in jumper is made. The spring elements can thus be made altogether approximately S-shaped, the connecting sections being used for reliable fixing and holding of the spring elements in the terminal housing. The production of the spring elements can be further simplified when a recess is punched out of the corresponding spring element, in particular its connecting section, as a receiver for plugging in one leg of a plug-in jumper. The spring elements can then be produced especially easily as punched-bent parts.

According to a further especially preferred configuration of the electrical terminal blocks in accordance with the invention, the two conductor bars each have one second resilient contact section, the two second contact sections being somewhat spaced apart from one another and together forming a second contact region for one plug of a test plug or isolating plug. The conductor bars are made such that the second contact region of the conductor bars is located between the first contact region of the conductor bars and the contact region of the two spring elements. In the plug-in direction of the plug the second contact region of the conductor bars is thus located upstream of the first contact region and downstream of the contact region of the two spring elements.

Forming the second contact region on the conductor bars ensures that an inserted plug of one test plug or isolating plug first of all connects the spring elements to the respective conductor bars before electrical contact of the two conductor bars in the first contact region is broken by the plug's being inserted.

If the plug of a test plug or isolating plug is being plugged into the electrical terminal block, this leads first of all to the plug with its two plug metals which are insulated from one another making contact with the contact sections of the two spring elements. If the plug is plugged further into the electrical terminal block, the plug metals of the plug each additionally make contact with a second resilient contact section of the conductor bars so that one spring element at a time is connected in an electrically conductive manner to one conductor bar via one plug metal of the plug. Only if the plug is plugged still further into the terminal block is the electrical contact between the first contact sections of the two conductor bars broken by the plug so that then the conductor connecting elements are no longer electrically connected to one another.

In addition to the two spring elements, the two conductor bars can also be produced from pieces of metal by punching out and subsequently folding and bending. The two conductor bars each preferably consist of two individual metal strips which are connected to one another in an electrically conductive manner, in particular are welded, soldered or riveted to one another. The connecting section of one conductor bar can then be formed by the first metal strip and the contact section or sections of the conductor bar can be formed by the second metal strip. This simplifies the production of the conductor bars and it is moreover possible to use, for the connecting section on the one hand and the resilient contact sections on the other, different materials and/or different cross sections which are selected according to the respectively required stiffness and spring property.

The first metal strip which forms the connecting section can be made relatively rigid, while the second metal strip itself is made as a contact spring. The contact spring can be bent roughly into a C shape, the first end of the contact spring forming the first contact section and the second end of the contact spring forming the second contact section.

In the block of terminal blocks which was described at the beginning, consisting of at least two terminal blocks which are located next to one another and of at least one plug-in jumper, the object underlying the invention is achieved in that in at least one spring element of the first terminal block and the corresponding spring element of the second terminal block one leg of the plug-in jumper at a time is plugged. In this way two conductor connecting elements of the two terminal blocks are connected to one another in a electrically conductive manner when one plug of a test or isolating plug at a time is plugged into the two terminal blocks, via which plug one spring element at a time is connected in an electrically conductive manner to the assigned conductor bar.

In this block of terminal blocks cross bridging takes place via the plug-in jumper which has been plugged into the two terminal blocks and whose legs are each plugged into a corresponding recess in one spring element of one terminal block, when the test or isolating plug has been plugged in the spring elements being connected in an electrically conductive manner via the plug of the test or isolating plug to the assigned conductor bar and thus also to the assigned conductor connecting element.

Using a corresponding made plug-in jumper also makes it possible to connect two electrical terminal blocks to one another which are not located directly next to one another, i.e., two terminal blocks can be electrically connected to one another via a corresponding plug-in jumper, between which blocks there are further terminal blocks. In addition, it is also possible using a corresponding made plug-in jumper to connect more than two terminal blocks to one another, here too not all terminal blocks which are located next to one another needing to be connected to one another, but individual terminal blocks also being able to be omitted.

The electrical terminal blocks which together form the block of terminal blocks are made disk-shaped. So that several terminal blocks can together form a block of terminal blocks, the individual terminal blocks are preferably mechanically connected to one another, for which the terminal blocks are latched together via corresponding latch elements which are made in the terminal housing. The latch elements preferably consist of latch pins which are located on one side of the terminal housing and of corresponding latch recesses which are made in the other side of the terminal housing.

In particular, there are a host of possibilities for configuring and developing the electrical terminal block in accordance with the invention and the block of terminal blocks in accordance with the invention. For this purpose, reference is made the following description of a preferred exemplary embodiment in conjunction with the accompanying drawings.

BRIEF DESCRIPTION OF THE DRAWINGS

FIG. 2 shows the terminal block according to FIG. 1, with a test plug plugged in, FIG. 3 shows a terminal block, with a test plug which has not yet been fully plugged in.

DETAILED DESCRIPTION OF THE INVENTION

Figure 1:
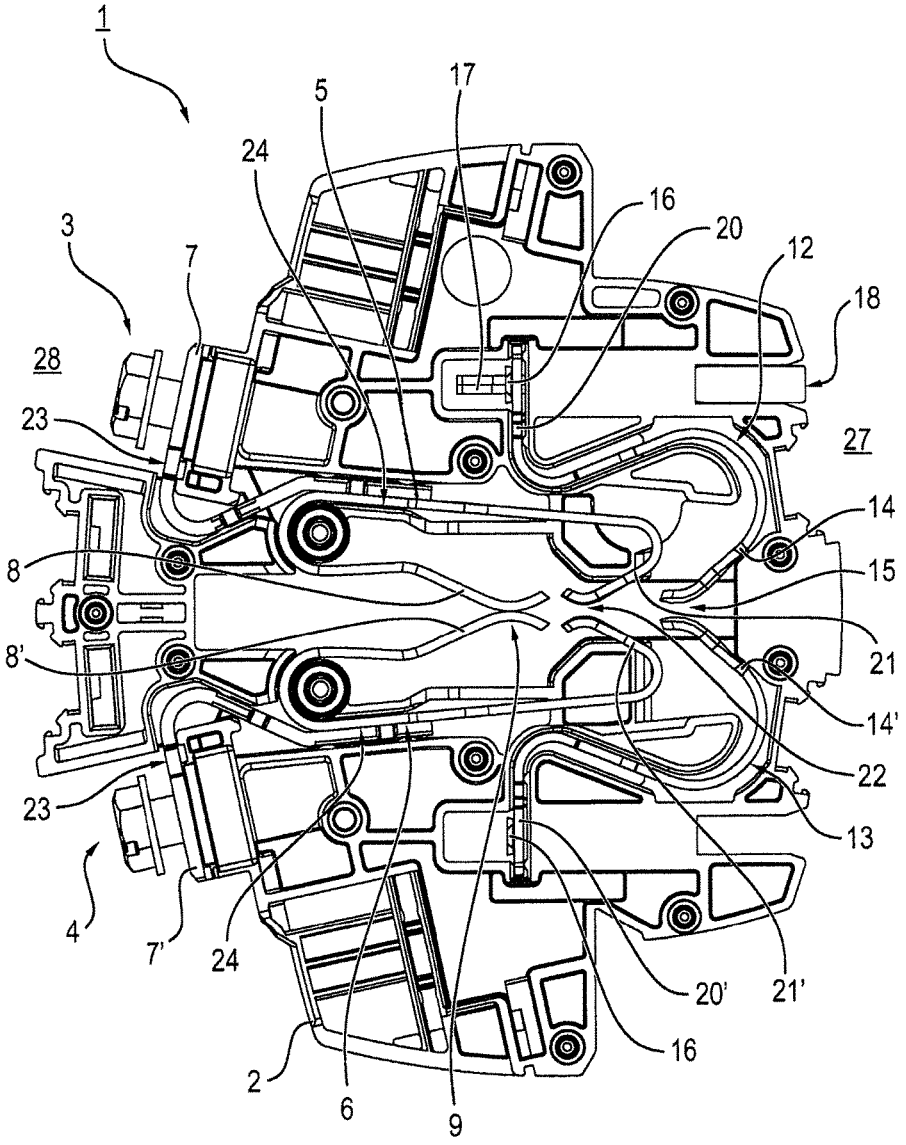
FIG. 1 shows one exemplary embodiment of an electrical terminal block in a side view.

The electrical terminal block 1 in accordance with the invention which is shown in FIG. 1 has a terminal housing 2 of plastic which in the illustrated embodiment can be inserted and fastened in an opening of one wall, in particular a wall of a control cabinet. Within the terminal housing 2 there are two conductor connecting elements 3, 4 which are screw-type terminals here. But alternatively other types of connecting elements, for example tension spring terminals, leg spring terminals or insulation piercing connecting devices can also be used as conductor connecting elements.

Figure 2:
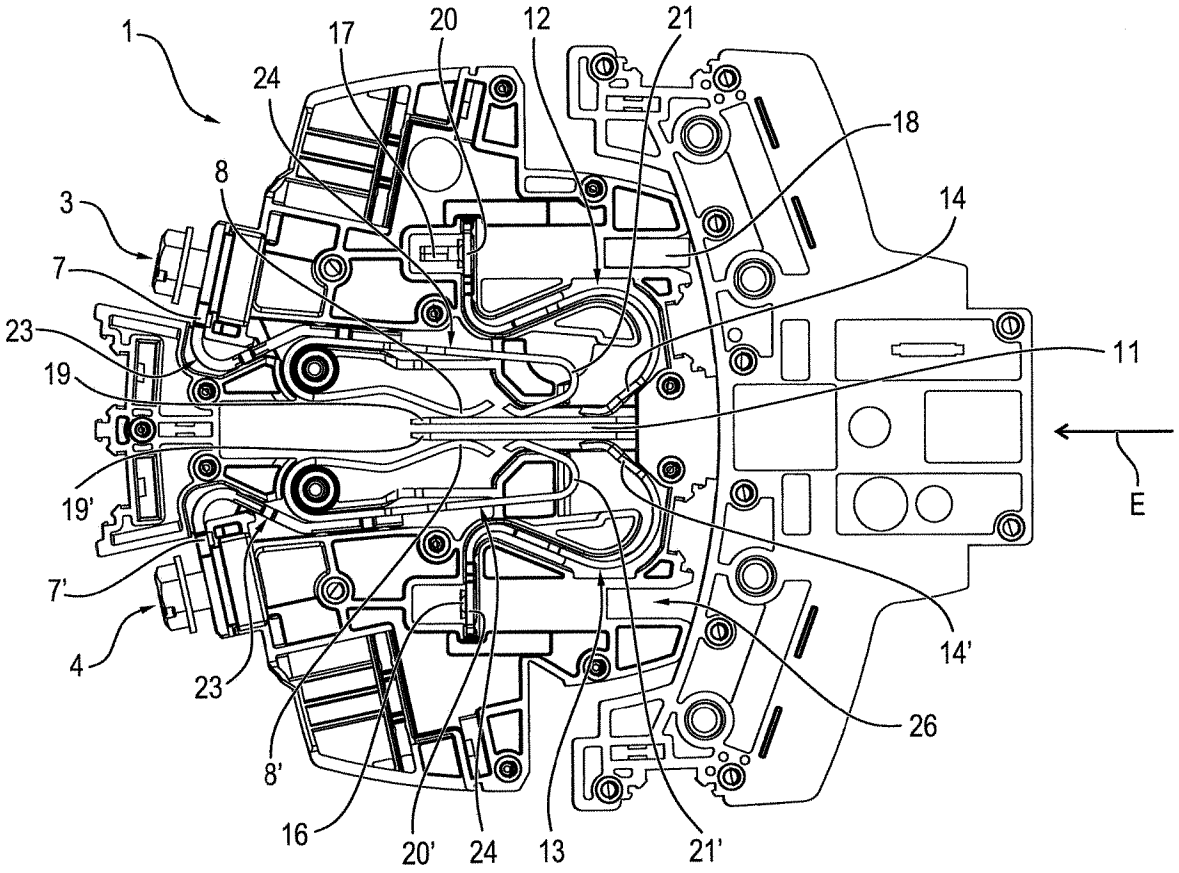
Figure 5:
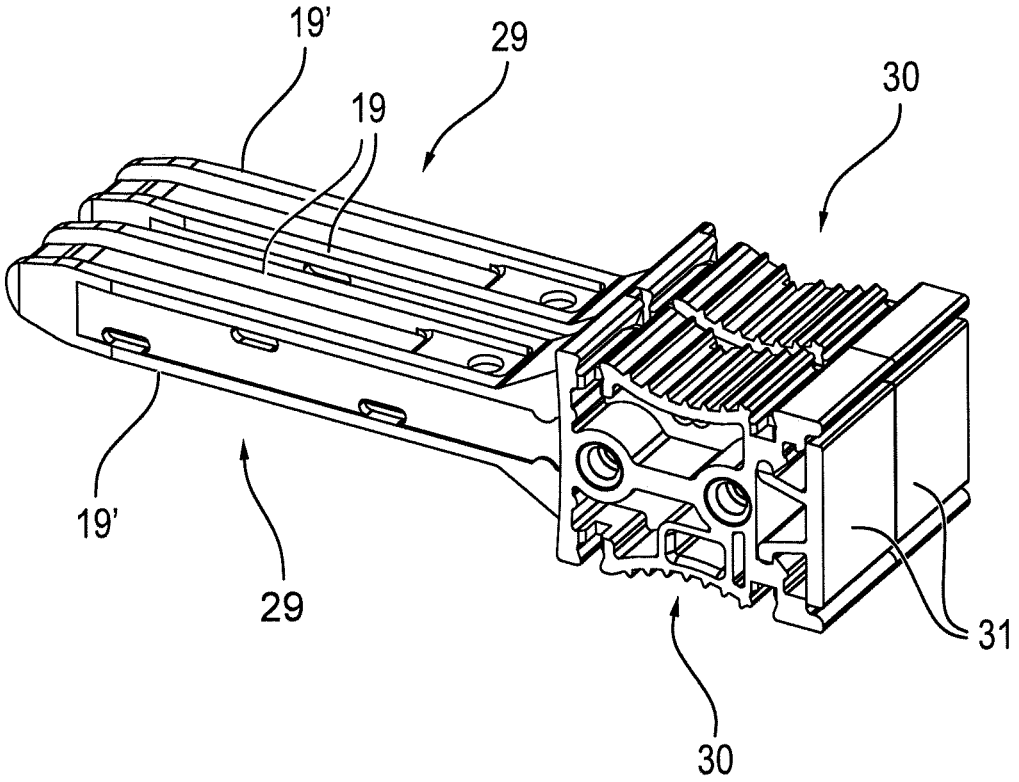
FIG. 5 shows two isolating plugs which are located next to one another.

In the terminal housing 2 there are moreover two more conductor bars 5, 6 which are made the same and which are located mirror-symmetrically to one another. The conductor bars 5, 6 each have on their one end a connecting section 7, 7' which is assigned to a respective one of the two conductor connecting elements 3, 4, i.e., is inserted into the screw terminals. Moreover, the two conductor connecting elements 3, 4 each have another first contact section 8, 8' which together form a resilient first contact region 9 for accommodating the metal insertion portions of a test plug 11 which is shown in FIG. 2 or an isolating plug 29 which is shown in FIG. 5. As is apparent from FIG. 1, the two contact sections 8, 8' make contact if a plug 11 has not been inserted so that the two conductor connecting elements 3, 4 are connected to one another in an electrically conductive manner via the two conductor bars 5, 6 in the base state in which a test plug 11 or isolating plug 29 has not been inserted.

The electrical terminal block 1 in accordance with the invention moreover has two more spring elements 12, 13 which are located in the terminal housing 2 and which in the base state of the terminal block 1 according to FIG. 1, i.e., with the test plug 11 not plugged in, are not connected to the conductor bars 5, 6 in an electrically conductive manner. The two spring elements 12, 13, each have one resilient contact section 14, 14', the spring elements 12, 13 being arranged mirror-symmetrically to one another such that the contact sections 14, 14' form a further contact region 15 for the two insertion portions 19, 19' of a test plug 11 or of an isolating plug 29. The contact sections 14, 14', as shown in the figures, can have a distance to one another so that they do not make contact. Fundamentally, the contact sections 14, 14' can however also be made and located such that the contact sections 14, 14' make contact when a plug 11 or 29 has not been plugged in.

The spring elements 12, 13 are used to easily produce cross bridging between two terminal blocks 1, 1'. To do this, in at least one of the two spring elements 12, 13 a recess 16 is formed as a receiver for one leg 17 of a plug-in jumper 18. For two adjacent terminal blocks 1, 1' then two spring elements 12 or 13 are electrically connected to one another via the two legs 17 of one plug-in jumper 18.

According to FIG. 2, if the insertion portion of a test plug 11 is plugged into a terminal block 1, this leads to a respective spring element 12, 13 being connected in an electrically conductive manner to the assigned conductor bar 5, 6 via a respective metal insertion portions 19, 19'. In the completely plugged-in state of the respective metal insertion portions 19, 19', the two conductor bars 5, 6 in the first contact region 9 are moreover separated from one another by the plug 11 or 29 so that then the two conductor connecting elements 3, 4 are also no longer electrically connected to one another via the conductor bars 5, 6. The spring elements 12, 13 which can be produced easily by punching and subsequently bending from one metal strip, in addition to the roughly C-shaped contact sections 14, 14', each have another essentially straight connecting section 20, 20' in which the recess 16 is punched out for plugging in the leg of a plug-in jumper test plug 11. Altogether, the spring elements 12, 13 thus have a rough S shape, the spring elements 12, 13 preferably being attached in the terminal housing 2 via correspondingly made projections.

Figure 3:
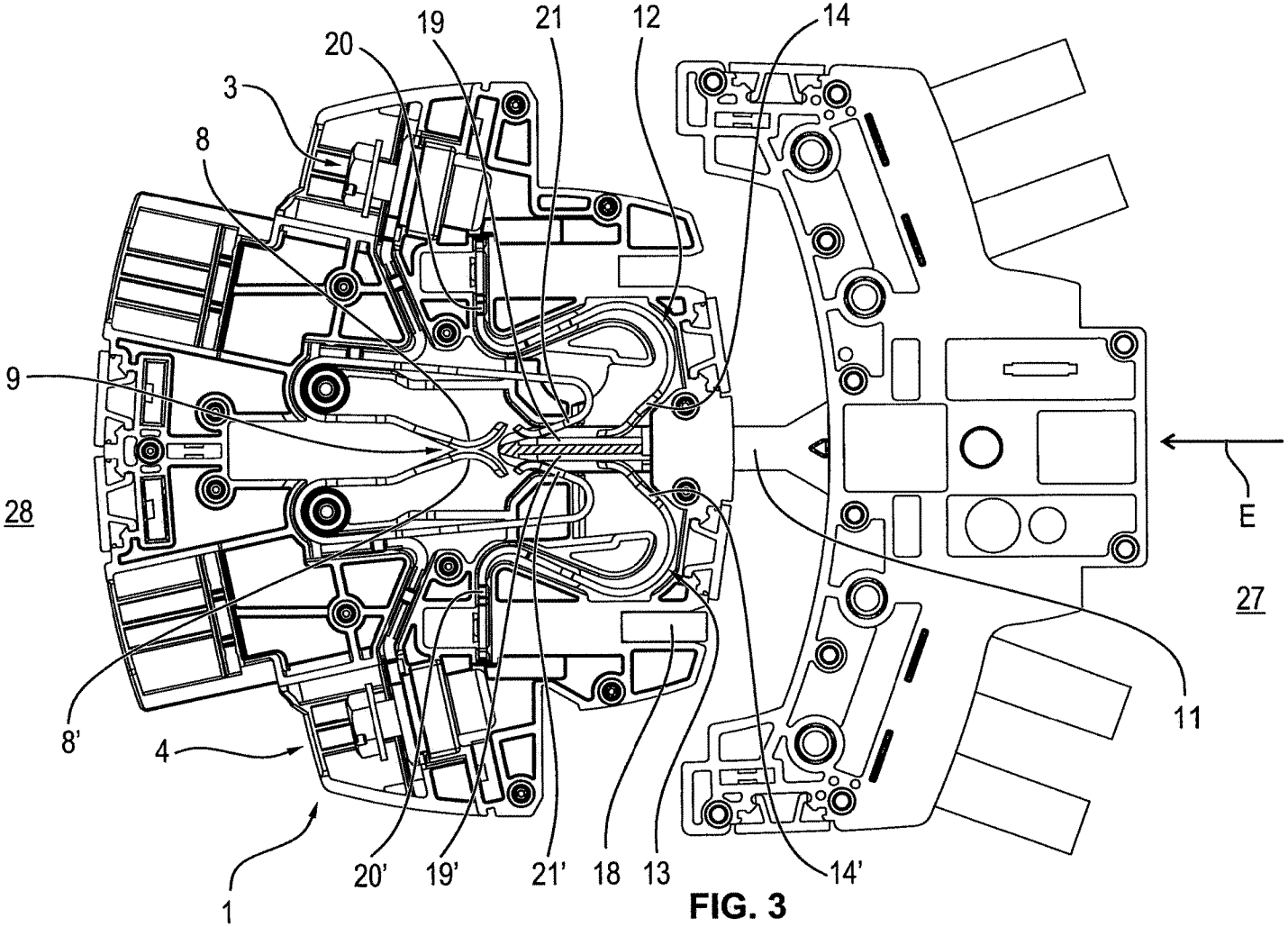

When the plug 11 or 29 is being plugged into the terminal block 1 in order to reliably ensure that first of all the spring elements 12, 13 are electrically connected to the conductor bar 5, 6 before the electrical connection between the two conductor bars 5, 6 in the first contact region 9 is broken, the conductor bars 5, 6 each have another second resilient contact section 21, 21'. The second contact sections 21, 21' which have a distance from one another together form a second contact region 22 which is located in the plug-in direction E of the plug 11 or 29 upstream of the first contact region 9 of the conductor bars 5, 6 and downstream of the contact region 15 of the spring elements 12, 13. When the plug 11 or 29 is plugged into the terminal block 1, the two metal insertion portions 19, 19' thus first make contact with the contact sections 14, 14' of the two spring elements 12, 13 and the second contact sections 21, 21' of the conductor bars 5, 6 so that the spring elements 12, 13 are electrically connected to the conductor bars 5, 6 via the metal insertion portions 19, 19', as is shown in FIG. 3. Only if the metal insertion portion 19, 19' is still further plugged in, does it enter the first contact region 9, as a result of which the first contact sections 8, 8' of the conductor bars 5, 6 are separated from one another.

In the exemplary embodiment of the electrical terminal block 1 which is shown in the figures, the two conductor bars 5, 6 each is comprised of two individual elongated metal strips 23, 24 which are soldered, welded or riveted to one another in the transition region. The two connecting sections 7, 7' are formed here by the first bent metal strip 23 whose ends which face away from the second metal strip 24 project into the clamping part of the screw terminal 3, 4. While the first metal strips 23 are relatively rigid, the altogether roughly C-shaped second metal strips 24 are made as contact springs, as a result of which the contact forces which are required in the first contact region 9 and in the second contact region 22 can be easily implemented. By using different materials and different cross sections for the metal strips 23, 24, the conductor bars 5, 6 can be optimally adapted to the different requirements in the connecting section 7, 7' on the one hand and in the contact regions 9, 22 on the other.

Figure 4:
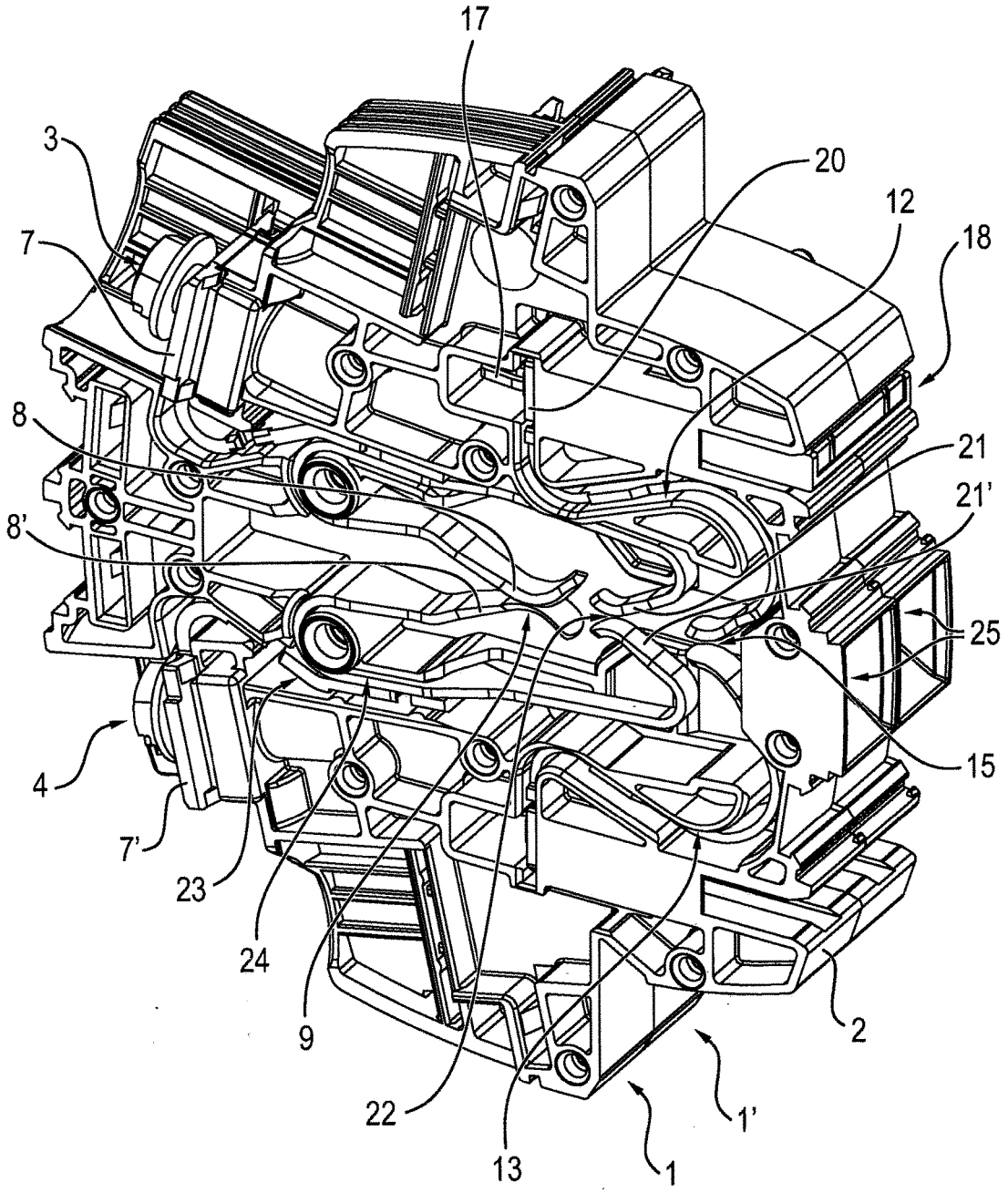
FIG. 4 shows a block of terminal blocks which has been assembled from two terminal blocks, obliquely from the side.

FIG. 4 shows a block of terminal blocks which is formed of two terminal blocks 1, 1', the two terminal blocks 1, 1' being connected to one another via a plug-in jumper 18 whose two plugs 17 are each plugged into one recess 16 in one spring element 12 of the two terminal blocks 1, 1'. In the terminal housing 2 of the terminal blocks 1 one opening 25 at a time for plugging the metal insertion portion of a test plug 11 into the contact regions 9, 15 and 22 is made in the middle. Moreover, on the two sides of the opening 25, a respective further opening 26 is made for plugging the leg 17 of a plug-in jumper 18 into the recess 16 in a connecting section 20, 21 of one spring element 12, 13.

The openings 25, 26 are accessible here from the first side 27, the operator side of the terminal block 1. This has the advantage that in an arrangement of the terminal block 1 or a corresponding block of terminal blocks in one opening of a door of a control cabinet both a test plug 11 and also a plug-in jumper 18 can be plugged into the terminal blocks 1, 1' without the door of the control cabinet having to be opened for this purpose. Another advantage is that the plug-in jumpers 18 are easily recognizable from the front for an operator, as a result of which it can also be clearly recognized to which terminal blocks current transformers are connected. The connection of the electrical lines for example of one current transformer takes place conversely from the second side 28, the connecting side of the terminal block 1 which is then located within the control cabinet.

Instead of a test plug 11, an isolating plug 29 can also be plugged into the opening 25 in the terminal housing 2. FIG. 5 shows two such isolating plugs 29 which are located next to one another and which can be plugged, for example, into the two terminal blocks 1, 1' which are shown in FIG. 4. Like the test plug 11, the isolating plug 29 also has a metal insertion portions 19, 19' which are insulated from one another. For better handling, on the isolating plug 29, moreover, another handle region 30 is formed on which an identification plate 31 can be attached.

Figure 6:
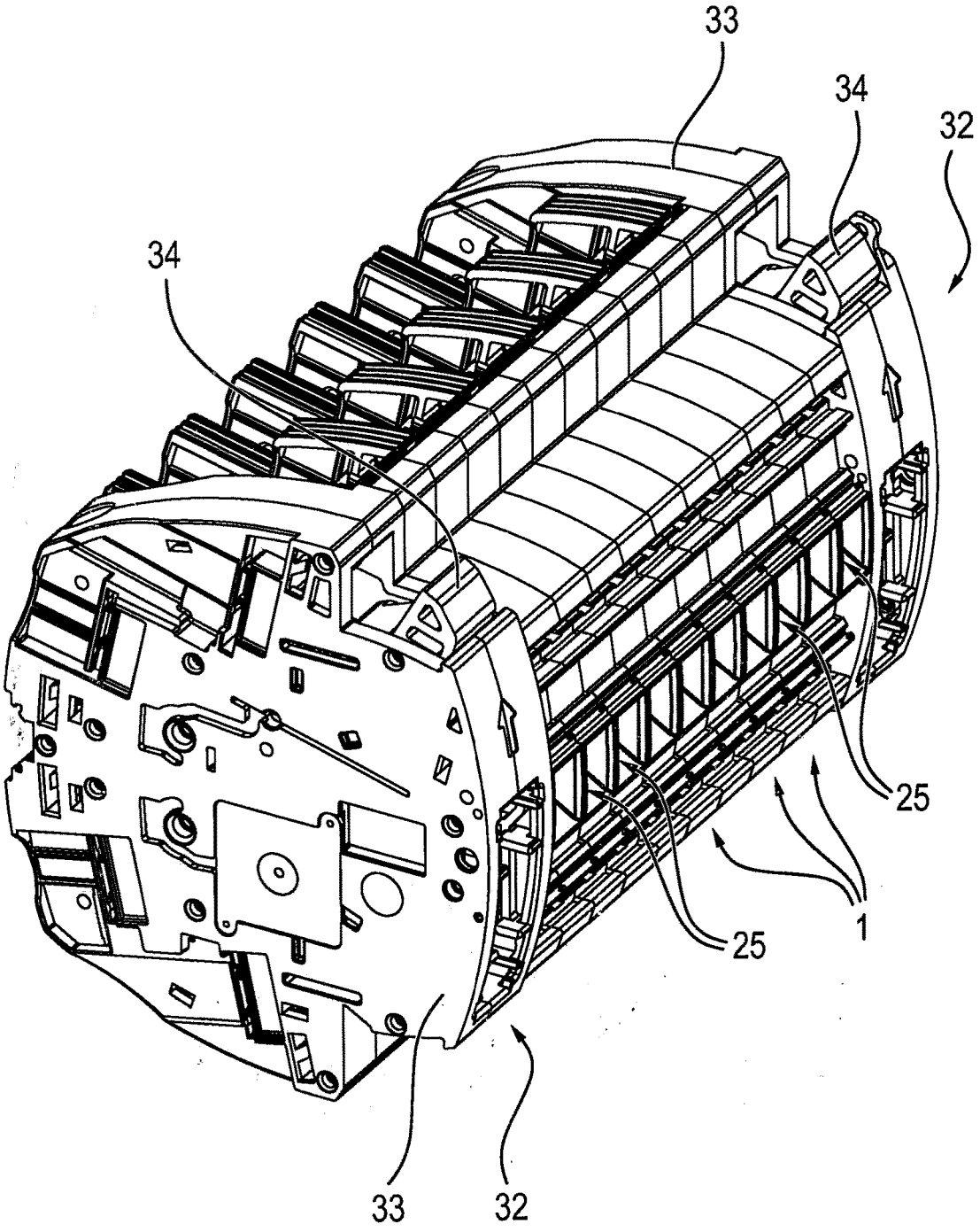
FIG. 6 shows a perspective of a block of terminal blocks which consists of several terminal blocks.

FIG. 6 shows a block of terminal blocks which is comprised of several terminal blocks 1. On the two sides of the plurality of terminal blocks 1 which are connected to one another, there is one mounting terminal 32 each which are used for simple and reliable mounting of the block of terminal blocks in an opening of a door of a control cabinet. For this purpose, in the terminal housing 33 of the mounting terminal 32 a fixing element 34 is movably located and can be moved into a clamping position using an actuating element, for example, a screw driver.

The invention claimed is:

1. An electrical terminal block, comprising a terminal housing, at least two conductor connecting elements located in the terminal housing, and two conductor bars, each of which have a connecting section and at least one resilient contact section, each connecting section being associated with a respective conductor connecting element and the contact sections together forming a contact region for accommodating and making contact with a plug, and the contact sections having a basic position in which the connecting elements are electrically connected to one another via the two conductor bars and from which the contact sections are displaceable by insertion of a plug therebetween, and two spring elements located in the terminal housing, each spring element having a respective further resilient contact section, the contact sections of the two spring elements together forming another contact region for a plug which is located in a plug-in direction of the plug upstream of the contact region of the conductor bars, wherein at least one of the spring elements has a receiver for a leg of a plug-in jumper, wherein a respective spring element is connected in an electrically conductive manner to one of the conductor bars via the plug when a plug of a test or isolating plug has been inserted into the terminal block, whereas a respective spring element is disconnected in an electrically conductive manner from one of the conductor bars prior to insertion of the plug of a test or isolating plug into the terminal block.

2. The electrical terminal block as claimed in claim 1, wherein the resilient contact sections of the two spring elements are each essentially C-shaped or V-shaped.

3. The electrical terminal block as claimed in claim 1, wherein the two spring elements each have one connecting section in which the receiver for plugging in one leg of a plug-in jumper is made.

4. The electrical terminal block as claimed in claim 1, wherein at least one of the spring elements has a receiver recess for plugging in a leg of a plug-in jumper.

5. Electrical terminal block, comprising a terminal housing, at least two conductor connecting elements located in the terminal housing, and two conductor bars, each of which have a connecting section and at least one resilient contact section, each connecting section being associated with a respective conductor connecting element and the contact sections together forming a contact region for accommodating and making contact with a plug, and the contact sections having a basic position in which the connecting elements are electrically connected to one another via the two conductor bars and from which the contact sections are displaceable by insertion of a plug therebetween, and two spring elements located in the terminal housing, each spring element having a respective further resilient contact section, the contact sections of the two spring elements together forming another contact region for a plug which is located in a plug-in direction of the plug upstream of the contact region of the conductor bars, wherein at least one of the spring elements has a receiver for a leg of a plug-in jumper, wherein a respective spring element is connected in an electrically conductive manner to one of the conductor bars via the plug when a plug of a test or isolating plug has been inserted into the terminal block, and wherein the two conductor bars each have a second resilient contact section which are spaced apart from one another and together form a second contact region for a plug, the second contact region of the conductor bars being located between a first contact region of the conductor bars and the contact region of the two spring elements in a plug-in direction of the plug.

6. The electrical terminal block as claimed in claim 1, wherein the two conductor bars each are formed of two individual metal strips which are connected to one another in an electrically conductive manner, the two connecting sections each being formed from a first metal strip and the contact sections each being formed from a second metal strip.

7. The electrical terminal block as claimed in claim 1, wherein an opening for plugging the plug of a test isolating plug into the contact regions and at least one opening for plugging in a leg of a plug-in jumper into the receiver of spring element are provided in the terminal housing, the openings being accessible from an operator side of the terminal housing.

8. A block formed of a plurality of terminal blocks which, each of which comprises a terminal housing, at least two conductor connecting elements located in the terminal housing, and two conductor bars, each of which have a connecting section and at least one resilient contact section, each connecting section being associated with a respective conductor connecting element and the contact sections together forming a contact region for accommodating and making contact with a plug, and the contact sections having a basic position in which the connecting elements are electrically connected to one another via the two conductor bars and from which the contact sections are displaceable by insertion of a plug therebetween, and two spring elements located in the terminal housing, each spring element having a respective further resilient contact section, the contact sections of the two spring elements together forming another contact region for a plug which is located in a plug-in direction of the plug upstream of the contact region of the conductor bars, wherein at least one of the spring elements has a receiver for a leg of a plug-in jumper, wherein a respective spring element is connected in an electrically conductive manner to one of the conductor bars via the plug when the plug of an inserted test or isolating plug is inserted, and further comprising at least one plug-in jumper which has at least two legs, wherein in at least one spring element of a first of the terminal blocks and in the corresponding spring element of a second of the terminal blocks, a respective leg of the plug-in jumper is plugged so that the conductor connecting elements of the first and second electrical terminal blocks are connected to one another in an electrically conductive manner when a test isolating plug is plugged into the two terminal blocks.

9. The block of terminal blocks as claimed in claim 8, wherein the terminal blocks are mechanically connected to one another via a corresponding latch element of the terminal housing.

10. The block of terminal blocks as claimed in claim 8, wherein, on two sides of the plurality of terminal blocks which are located next to one another, there is a mounting terminal with a terminal housing having a fixing element which is movably located therein.

* * * * *